US006608977B2

(12) United States Patent
Tamaoki

(10) Patent No.: US 6,608,977 B2
(45) Date of Patent: Aug. 19, 2003

(54) TEMPERATURE CONTROL APPARATUS WITH SWITCHING CONTROL TO PREVENT MALFUNCTION FROM ELECTRICAL NOISE

(75) Inventor: Tomohiro Tamaoki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 10/050,850

(22) Filed: Jan. 18, 2002

(65) Prior Publication Data

US 2002/0098006 A1 Jul. 25, 2002

(30) Foreign Application Priority Data

Jan. 24, 2001 (JP) ..... 2001/016305

(51) Int. Cl.[7] ..... G03G 15/20
(52) U.S. Cl. ..... 399/69; 219/216
(58) Field of Search ..... 399/37, 67, 69, 399/320, 328; 219/216, 600, 619, 660

(56) References Cited

U.S. PATENT DOCUMENTS 5,966,562 A * 10/1999 Maehara ..... 399/69
6,097,006 A * 8/2000 Inukai ..... 399/69 X
6,278,852 B1 * 8/2001 Hayashi ..... 399/69 X
6,449,445 B1 * 9/2002 Nakamori et al. ..... 399/69

* cited by examiner

*Primary Examiner*—Hoan Tran
(74) *Attorney, Agent, or Firm*—Fitzpatrick, Cella, Harper & Scinto

(57) ABSTRACT

A temperature control apparatus for controlling a fuser in an image forming apparatus is provided. The temperature control apparatus has a thermistor for detecting the temperature of a fusing roller; a switching circuit for turning ON/OFF the power supply to the fusing roller; and a microcomputer for periodically outputting, when controlling the temperature, an instruction signal instructing at least one of turning ON and OFF of the power supply to the fusing roller on the basis of the detected temperature. When the instruction signal to be periodically output from the microcomputer is output within a predetermined time longer than the instruction-signal output period, the switching circuit is turned ON/OFF in accordance with the instruction signal, and when no instruction signal is output, the switching circuit is turned OFF.

30 Claims, 8 Drawing Sheets

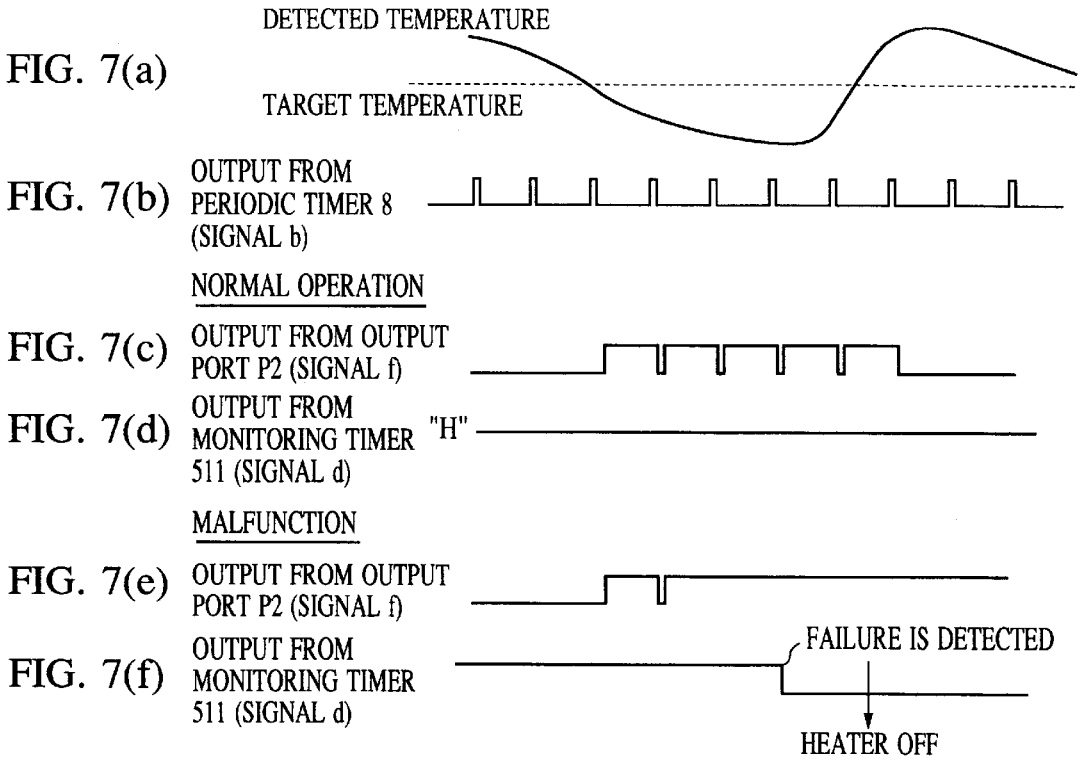
FIG. 8
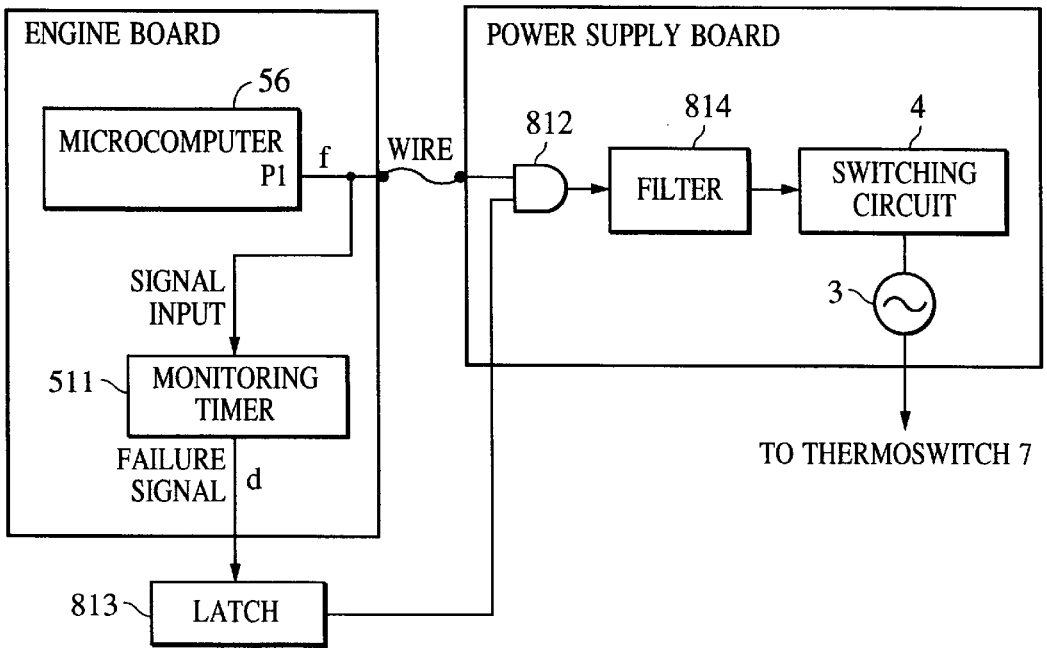

TEMPERATURE CONTROL APPARATUS WITH SWITCHING CONTROL TO PREVENT MALFUNCTION FROM ELECTRICAL NOISE

BACKGROUND OF THE INVENTION

1. Field of the Invention

The present invention relates to temperature control apparatuses for controlling the temperature of a heating unit.

2. Description of the Related Art

In a xerographic apparatus such as a copy machine, a toner image formed on a photo-sensitive drum is transferred to a sheet of transfer paper by a transfer device. The toner image on the transfer paper is thermally fused to the transfer paper by a heat fuser. A fusing roller incorporated in the heat fuser includes a built-in heater for heating the fusing roller so that the temperature of the surface of the fusing roller is maintained at a constant temperature.

A temperature control apparatus for such a fuser includes, for example, the temperature control apparatuses shown in FIG. 11 or FIG. 13.

The temperature control apparatus shown in FIG. 11 will now be described. An AC power supply 103 is connected through a switching circuit 104 to a heater 102 of a fusing roller 101. A thermistor 105 converts the temperature of the surface of the fusing roller 101 into an output signal a which has a voltage value in accordance with the temperature. The output signal a is input to an input port P0 of a microcomputer 106 and is subjected to A/D conversion. When a detected temperature is lower than a target temperature, the microcomputer 106 outputs H (ON) from an output port P1 to the switching circuit 104 (signal b). When the detected temperature is higher than the target temperature, the microcomputer 106 outputs L (OFF) from the output port P1 to the switching circuit 104.

A thermoswitch 107 is connected between the AC power supply 103 and the heater 102. When the microcomputer 106 continuously turns ON the output port P1 that controls ON/OFF of the switching circuit 104 as a result of the microcomputer 106 being out of control due to electric noise, a software bug, etc, the switching circuit 104 is continuously ON. As a result, the temperature of the fusing roller 101 increases excessively. In response to that condition, the thermoswitch 107 is operated so as to cut off the power supply to the fusing roller 101.

The temperature control apparatus shown in FIG. 12 will now be described. The AC power supply 103 is connected through the switching circuit 104 to the heater 102 of the fusing roller 101. The thermistor 105 converts the temperature of the surface of the fusing roller 101 into the output signal a including the voltage value in accordance with the temperature. The output signal a is input to an input port P0 of a microcomputer 116 and is subjected to A/D conversion. Bit 3 of a register 1167 that controls the output port P1 of the microcomputer 116 is assigned to switch ON/OFF the heater 102. When a detected temperature obtained by converting the signal a input to the input port P0 into a temperature is lower than a target temperature, the microcomputer 116 writes, for example, 1, instructing "heater-ON" to bit 3 of the register 1167. Accordingly, H (ON) is output from the output port P1 to the switching circuit 104 (signal b). In contrast, when the detected temperature is higher than the target temperature, the microcomputer 116 writes 0 instructing "heater-OFF" to bit 3 of the register 1167. Accordingly, L (OFF) is output from the port P1 (signal b). Bits other than bit 3 of the register 1167 are assigned to control other input/output ports. The thermoswitch 107, which cuts off the power supply to the heater 102 in case of excessive temperature rise of the fusing roller 101, is connected between the AC power supply 103 and the heater 102.

The temperature control apparatus shown in FIG. 13 will now be described. Unlike the temperature control apparatus shown in FIG. 12, a register 1207 for writing 1 and 0 instructing heater ON/OFF is provided in an integrated circuit (IC) 120 outside a microcomputer 126. An address bus, a data bus, and a control signal of the microcomputer 126 are connected to the IC 120.

In the temperature control apparatuses shown in FIGS. 11 to 13, the thermoswitch 107, which is supposed to operate in case of excess temperature rise, may not operate immediately when the temperature of the fusing roller 101 excessively increases. For example, when the temperature of the fusing roller 101 excessively increases from room temperature, the fusing roller 101 and a bus of the fusing roller 101 may break before the thermoswitch 107 is operated since it takes time before the temperature of the thermoswitch 107 increases.

In order to solve this problem, for example, a method is described in Japanese Laid-Open Patent No. 4-136881. According to the method, electricity to a heater is forced to be periodically turned OFF for a predetermined period of time. When a heater ON/OFF detection unit detects that the heater has been in the ON state for a predetermined period of time or longer, electricity to the heater is cut off.

According to the method, when electricity to the heater is cut off in response to a failure detected, it is impossible to determine whether the failure has occurred in a switching circuit such as a solid-state relay (SSR) or in a microprocessor.

Even when the temperature of a fusing roller is low, the power supply to the heater is periodically turned ON/OFF. As a result, the AC power supply voltage varies in accordance with interruption of current flowing to the heater during power feeding and cut-off periods.

In the temperature control apparatus shown in FIG. 12, the heater 102 is turned ON by simply writing 1 to bit 3 of the register 1167. A failure due to a simple bug in the program of the microcomputer 116 or noise may turn ON the heater 102.

In particular, because bits other than bit 3 of the register 1167 are assigned to other input/output ports, the register 1167 is frequently accessed for purposes other than turning ON/OFF the heater 102. Accordingly, bit inversion may occur as a result of electric noise generated when the register 1167 is accessed for purposes other than heater ON/OFF, thus unnecessarily turning ON the heater 102.

In the temperature control apparatus shown in FIG. 13, the IC 120 is provided outside the microcomputer 126; the address bus, the data bus, and the control signal of the microcomputer 126 are connected to the IC 120; and the microcomputer 126 writes to the register 1207 in the IC 120. When controlling ON/OFF of the heater 102, the buses and control signal may be influenced by electric noise.

When the microcomputer 126 tries to gain write access to another address, part of the address may be inverted by electric noise. The IC 120 may erroneously detect this as writing to the register 1207.

In response to the false detection, the heater 102 may be turned ON. When the register 1207 is accessed to rewrite bits assigned to other functions, bit 3 for heater ON/OFF may be inverted by electric noise. As a result, the heater 102 may be turned ON unnecessarily.

SUMMARY OF THE INVENTION

Accordingly, it is a first object of the present invention to provide a temperature control apparatus for solving the foregoing problems and for stopping the power supply to a heater before the temperature of a fusing roller excessively increases.

A second object of the present invention is to provide a temperature control apparatus for solving the foregoing problems and for detecting a failure in the temperature control apparatus without unnecessarily turning ON/OFF a heater even when it is necessary to continuously supply electricity to the heater.

A third of object of the present invention is to provide a temperature control apparatus for solving the foregoing problems and for preventing a malfunction due to electric noise.

In accordance with these and other objects, there is provided a temperature control apparatus that includes a temperature detector for detecting the temperature of a heating unit; a switching circuit for turning ON/OFF the power supply to the heating unit in accordance with an ON/OFF instruction; and an instruction unit for instructing, every predetermined period of time, the switching circuit to turn ON the power supply when the temperature detected by the temperature detector is lower than a target temperature and to turn OFF the power supply when the detected temperature is higher than the target temperature. A determination unit determines that a failure has occurred when no instruction is given from the instruction unit within a preset time longer than the predetermined period of time. When the determination unit determines that the failure has occurred, the power supply to the heating unit is turned OFF.

In another aspect, the determination unit includes a generation unit for generating a failure detection signal when it is determined that the failure has occurred; and a latch unit for latching the failure detection signal generated by the generation unit. The switching circuit may turn OFF the power supply to the heating unit while the failure detection signal is being latched by the latch unit.

The temperature control apparatus may also include an initialization unit for initializing the temperature control apparatus when the determination unit determines that the failure has occurred.

The initialization unit initializes the temperature control apparatus except for the latch unit. A failure-signal maintaining unit may be provided to prevent the power to be again supplied to the heating unit after the initialization.

The determination unit includes an informing unit for reporting the occurrence of the failure when it is determined that the failure has occurred.

In accordance with one aspect of the present invention, the heating unit may include a fusing roller with a heater, or an induction coil and an electromagnetic-induction heating member, and the temperature detector may include a contact-type temperature sensor, such as a thermistor, for making contact with an object and detecting the temperature of the object, or a non-contact-type temperature sensor, such as a built-in thermistor, for detecting the temperature of an object without making contact with the object.

According to another aspect of the present invention, a temperature control apparatus includes a temperature detector for detecting the temperature of a heating unit; a switching circuit for turning ON/OFF the power supply to the heating unit in accordance with an ON/OFF instruction; an instruction unit for instructing, every predetermined period of time, the switching circuit to turn ON the power supply when the temperature detected by the temperature detector is lower than a target temperature and to switch OFF the power supply when the detected temperature is higher than the target temperature. The instruction unit instructs the switching circuit to turn OFF the power supply at least once in each predetermined period of time. A determination unit determines that a failure has occurred when the OFF-instruction is not given from the instruction unit within a preset time which is longer than the predetermined period of time. When the determination unit determines that the failure has occurred, the power supply to the heating unit is turned OFF.

In accordance with yet another aspect of the invention, the determination unit includes a generation unit for generating a failure detection signal when it is determined that the failure has occurred; and a latch unit for latching the failure detection signal generated by the generation unit. The switching circuit may turn OFF the power supply to the heating unit while the failure detection signal is being latched by the latch unit.

The temperature control apparatus may also include an initialization unit for initializing the temperature control apparatus when the determination unit determines that the failure has occurred. The initialization unit initializes the temperature control apparatus except for the latch unit. The switching circuit may turn OFF the power supply to the heating unit while the failure detection signal is being latched by the latch unit after the initialization of the temperature control apparatus except for the latch unit.

In accordance with still another aspect of the invention, the temperature control apparatus further includes an informing unit for reporting the occurrence of the failure when the determination unit determines that the failure has occurred.

In accordance with yet another aspect of the invention, the heating unit may include a fusing roller with a heater, or an induction coil and an electromagnetic-induction heating member.

According to another aspect of the present invention, a temperature control apparatus includes a temperature detector for detecting the temperature of a heating unit; an instruction unit for giving an ON-instruction when the temperature detected by the temperature detector is lower than a target temperature and to give an OFF-instruction when the detected temperature is higher than the target temperature; first to n-th ($\geqq 2$) registers; a first setting unit for setting a first predetermined value to the first register when the ON-instruction is given by the instruction unit and to set a second predetermined value when the OFF-instruction is given by the instruction unit; a second setting unit for setting, before the first setting unit sets the first predetermined value to the first register, third to (n+1)-th predetermined values to the second to the n-th registers every time the ON-instruction is given by the instruction unit; a determination unit for determining whether or not the contents of the second to the n-th registers match the third to the (n+1)-th predetermined values, respectively, and to determine that the temperature control apparatus is in a heating-unit-ON-permitted state when the contents match the predetermined values; and a switching circuit for turning ON the power supply to the heating unit when it is determined by the determination unit that the temperature control apparatus is in the heating-unit-ON-permitted state and when the first predetermined value is set to the first register, and, when the first setting unit sets the second predetermined value to the first register, to turn OFF the power supply to the heating unit. Preferably, the second to the n-th registers each include an address differing from that of the first register.

In accordance with still another aspect of the invention, the temperature control apparatus further includes a clearing unit for clearing the second to the n-th registers when the determination unit determines that the temperature control apparatus is in the heating-unit-ON-permitted state and when the first predetermined value is set to the first register.

The temperature control apparatus further includes a clearing unit for clearing the first register when the determination unit determines that the temperature control apparatus is in the heating-unit-ON-permitted state and when the first predetermined value is set to the first register.

Preferably, the second to the n-th registers are cleared when the second predetermined value is set to the first register, and when not in the case that the contents of the second to the n-th registers are cleared values, or the third to the (n+1)-th predetermined values, respectively, it is determined that a failure has occurred and the switching circuit turns OFF the power supply to the heating unit. When not in the case that the content of the first register is a cleared value, the first predetermined value, or the second predetermined value, it is determined that a failure has occurred and the power supply to the heating unit is turned off.

When the first predetermined value is written to the first register and the temperature control apparatus is not in the heating-unit-ON-permitted state, it is determined that a failure has occurred and the power supply to the heating unit is turned off.

In accordance with still another aspect of the invention, the temperature control apparatus further includes an informing unit for reporting the occurrence of the failure when it is determined that a failure has occurred.

In accordance with still yet another aspect of the invention, the temperature control apparatus further includes an initialization unit for initializing the temperature control apparatus when it is determined that the failure has occurred; a maintaining unit for maintaining the failure state when it is determined that the failure has occurred; and an inhibiting unit for inhibiting the power supply to the heating unit after the initialization by the initialization unit when the failure state is maintained by the maintaining unit.

According to another aspect of the present invention, a temperature control apparatus includes a temperature detector for detecting the temperature of a heating unit; an instruction unit for giving an ON-instruction when the temperature detected by the temperature detector is lower than a target temperature and to give an OFF-instruction when the detected temperature is higher than the target temperature; first to m-th (≧3) registers; a first setting unit for setting a first predetermined value to the first register when the ON-instruction is given by the instruction unit; a second setting unit for setting a second predetermined value to the second register when the OFF-instruction is given by the instruction unit; a third setting unit for setting third to m-th predetermined values to the third to the m-th registers, respectively, before the first setting unit sets the predetermined value to the first register; a determination unit for determining whether or not all the contents of the third to the m-th registers match the third to the m-th predetermined values, respectively, and to determine that the temperature control apparatus is in a heating-unit-ON-permitted state when the contents match the predetermined values; and an ON/OFF for turning ON the power supply to the heating unit when the determination unit determines that the temperature control apparatus is in the heating-unit-ON-permitted state and when the first predetermined value is set to the first register and, when the second predetermined value is set to the second register, to turn OFF the power supply to the heating unit.

Preferably, the first to the m-th registers each include an address differing from that of a register other than the first to the m-th registers, or the first to the m-th registers include different addresses.

The temperature control apparatus may further include a clearing unit for clearing the first register and the third to the m-th registers when the determination unit determines that the temperature control apparatus is in the heating-unit-ON-permitted state and when the first predetermined value is set to the first register.

When the contents of the third to the m-th registers are cleared or differ from the third to the m-th predetermined values, respectively, it is determined that a failure has occurred and the power supply to the heating unit is turned off.

When not in the case that the content of the first register is a cleared value or the first predetermined value, it is determined that a failure has occurred and the power supply to the heating unit is turned off.

When the first predetermined value is written to the first register and the temperature control apparatus is not in the heating-unit-ON-permitted state, it is determined that a failure has occurred and the power supply to the heating unit is turned off.

The temperature control apparatus may further include an informing unit for reporting the occurrence of the failure when it is determined that the failure has occurred; an initialization unit for initializing the temperature control apparatus when it is determined that the failure has occurred; a maintaining unit for maintaining the failure state when it is determined that the failure has occurred; and an inhibiting unit for inhibiting the power supply to the heating unit after the initialization by the initialization unit when the failure state is maintained by the maintaining unit, According to the present invention arranged as described above, the power supply to the heater can be stopped before the temperature of the fusing roller excessively increases.

According to the present invention arranged as described above, when it is necessary to have the heater continuously turned ON, a failure in the temperature control apparatus can be detected without unnecessarily turning ON/OFF the heater. According to the present invention, a malfunction due to electric noise can be prevented.

Further objects, features, and advantages of the present invention will become apparent from the following description of the preferred embodiments with reference to the attached drawings.

BRIEF DESCRIPTION OF THE DRAWINGS

FIGS. 7(*a*) through 7(*f*) are timing charts for illustrating the temperature control operation.

FIG. 8 is a block diagram of an example of a circuit that can prevent flickering from occurring.

DESCRIPTION OF THE PREFERRED EMBODIMENTS

With reference to the accompanying drawings, embodiments of the present invention will be described in detail.

First Embodiment

Figure 1:
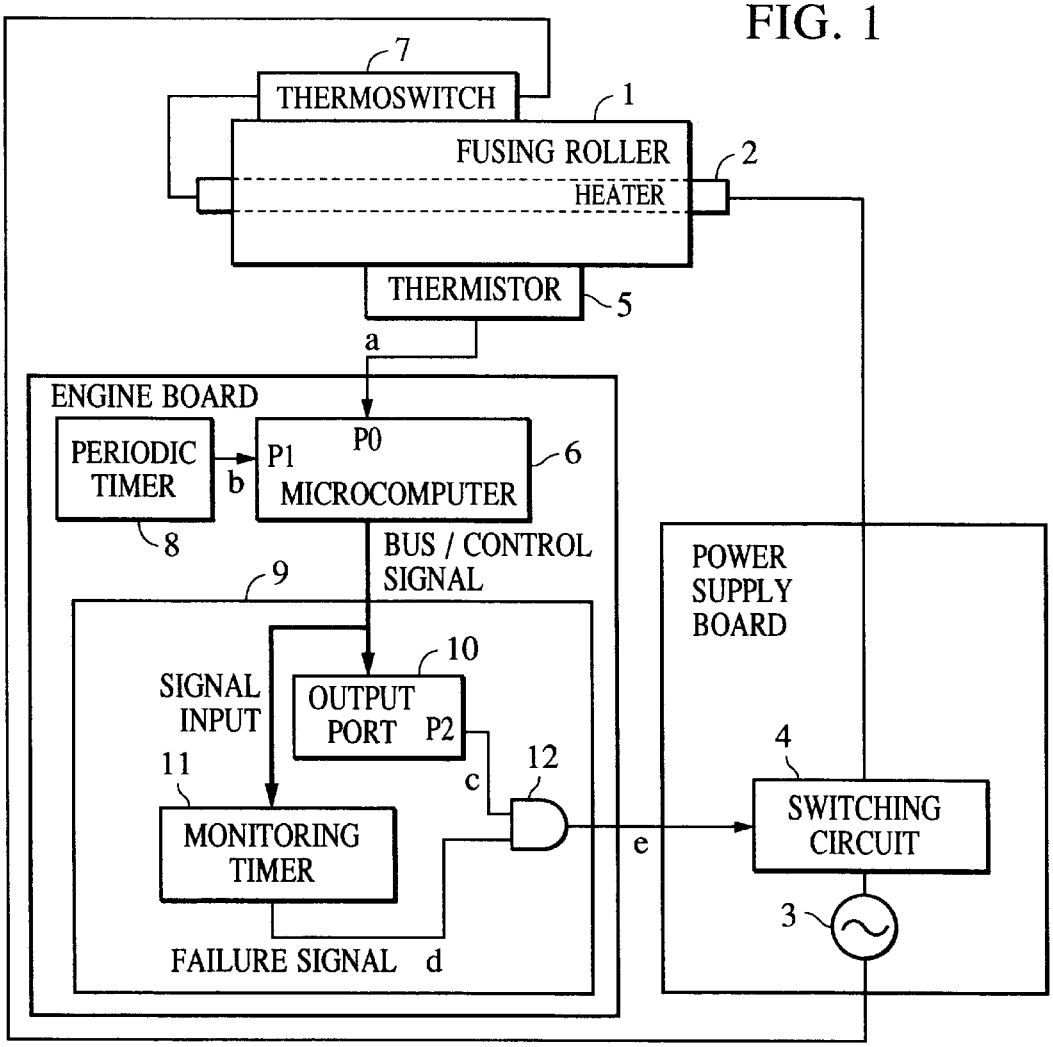
FIG. 1 is a block diagram of a temperature control apparatus according to a first embodiment of the present invention.

FIG. 1 shows a temperature control apparatus according to a first embodiment of the present invention. Referring to FIG. 1, a heater 2 is included in a fusing roller 1. The heater 2 is connected to an AC power supply 3 through a switching circuit 4. A thermistor 5 is in contact with the fusing roller 1 and detects temperature. A voltage signal a in accordance with temperature is input from the thermistor 5 to an input port P0 of a microcomputer 6. A thermoswitch 7 is connected between the AC power supply 3 and the heater 2. The thermoswitch 7 cuts off the power supply to the heater 2 when the temperature of the fusing roller 1 increases excessively. A timer output b from a periodic timer 8 is input to an input port P1 of the microcomputer 6. The microcomputer 6 controls the temperature with the timer input period.

A switching circuit controller 9 includes an output port 10, a monitoring timer 11, and an AND gate 12. A control signal from the microcomputer 6 is input via a bus to the output port 10 of the switching circuit controller 9. The microcomputer 6 accesses the output port 10 to control turning ON/OFF of the heater 2. When the microcomputer 6 gains write access in order to turn ON/OFF a port P2, the output port 10 controls a signal c for controlling the switching circuit 4 to be ON (H) or OFF (L). The monitoring timer 11 monitors access from the microcomputer 6 to the output port 10 and outputs a failure signal d which becomes L when a failure is detected. The output signal c of the output port 10 and the failure signal d of the monitoring timer 11 are ANDed by the AND gate 12. As a result, when the monitoring timer 11 detects a failure, a control signal e to be connected to the switching circuit 4 becomes L.

The microcomputer 6, the periodic timer 8, and the switching circuit controller 9 are disposed on an engine board. The AC power supply 3 and the switching circuit 4 are disposed on a power supply board.

The temperature control operation will now be described. When the timer output b of the periodic timer 8 is input to the input port P1, the microcomputer 6 performs A/D conversion of the voltage signal a output from the thermistor 5, converts the signal into a temperature, and compares the detected temperature with a target temperature. When the detected temperature is higher than the target temperature, the microcomputer 6 gains write access to the output port 10 in order to turn OFF the port P2. In contrast, when the detected temperature is lower than the target temperature, the microcomputer 6 gains write access to the output port 10 in order to turn ON the port P2.

Even when it is necessary to have the heater 2 continuously turned ON, the microcomputer 6 is programmed to gain write access to the output port 10 to turn ON the port P2 every time the timer output b of the periodic timer 8 is output.

When the output port 10 is turned ON, the monitoring timer 11 starts measuring time. When the output port 10 is write-accessed to again turn ON the port P2 or to turn OFF the port P2, the measured time is reset. When the output port 10 is ON, and when no write access to again turn ON the port P2 or write access to turn OFF the port P2 is gained for a preset period of time or longer, the monitoring timer 11 outputs a failure signal. The preset period of time is longer than the period of the periodic timer 8.

When a failure is detected, the failure signal d output from the monitoring timer 11 becomes L, and the failure signal d is input to the AND gate 12. When the failure is detected, the output e of the AND gate 12 becomes L. As a result, the switching circuit 4 is turned OFF.

Figure 2:
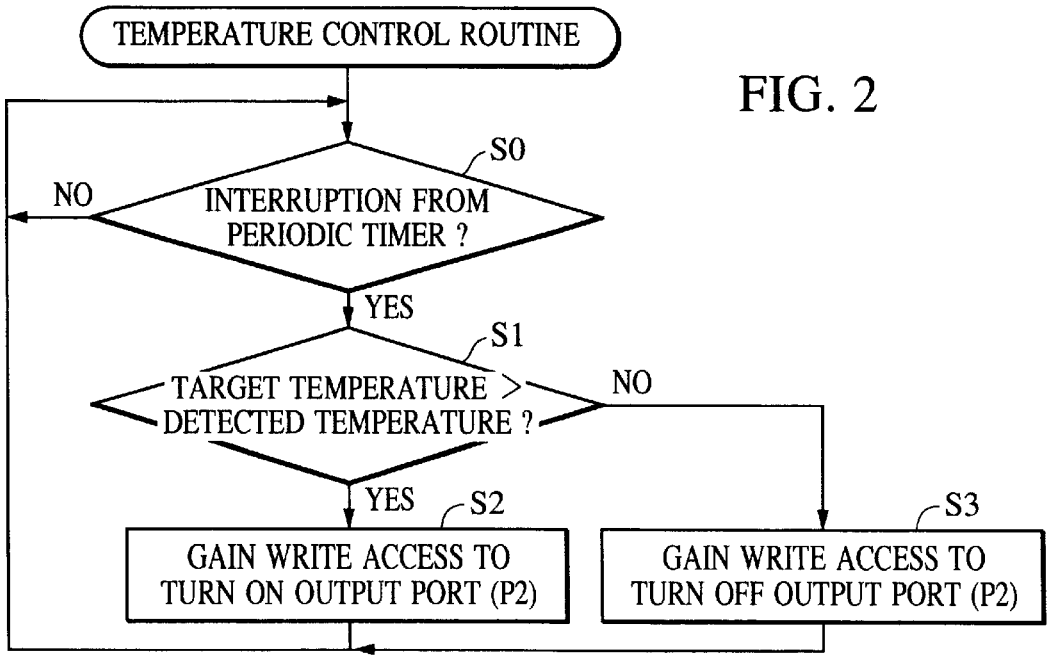
FIG. 2 is a flowchart showing an example of a program stored in a microcomputer.

FIG. 2 is a flowchart showing an example of a program stored in the microcomputer 6. When it is necessary to perform temperature control, a temperature control routine waits for the timer output (P1: signal b) from the periodic timer 8 in step S0. In response to the timer output, in step S1, the routine compares the detected temperature, which is obtained by converting the voltage signal a from the thermistor 5 into a temperature, with the target temperature. When the detected temperature is higher than the target temperature, the routine gains write access to the output port 10 to turn OFF the port P2 in step S3. Subsequently, the routine returns to step S0 and waits for a next timer output. In contrast, when the detected temperature is lower than the target temperature in step S1, the routine gains access to the output port 10 to turn ON the port P2. Subsequently, the routine returns to step S0.

When the output port P2 has already been H, and when the detected temperature is lower than the target temperature, the routine in step S2 gains write access to the output port 10 to turn on the port P2. As long as there is no failure in the microcomputer 6, it is ensured that the write access is periodically gained to the port P2 and that the monitoring timer 11 detects no failure.

When the monitoring timer 11 detects a failure, it detects that the microcomputer 6 is malfunctioning.

Referring to a timing chart in FIG. 3, the temperature control operation will now be described. The timer output b of the periodic timer 8 outputs timer pulses with a predetermined period (FIG. 3 (*b*)). In response to the timer output b of the periodic timer 8, the microcomputer 6 compares the temperature detected by the thermistor 5 with the target temperature (FIG. 3 (*a*)). When the detected temperature is higher than the target temperature, the microcomputer 6 gains write access (signal c) causing the port P2, relative to the switching circuit 4, to be L (FIG. 3 (*c*)). No electricity is supplied to the heater 2.

Figures 3A, 3B, 3C, 3D, 3E, 3F, 3G, 3H:
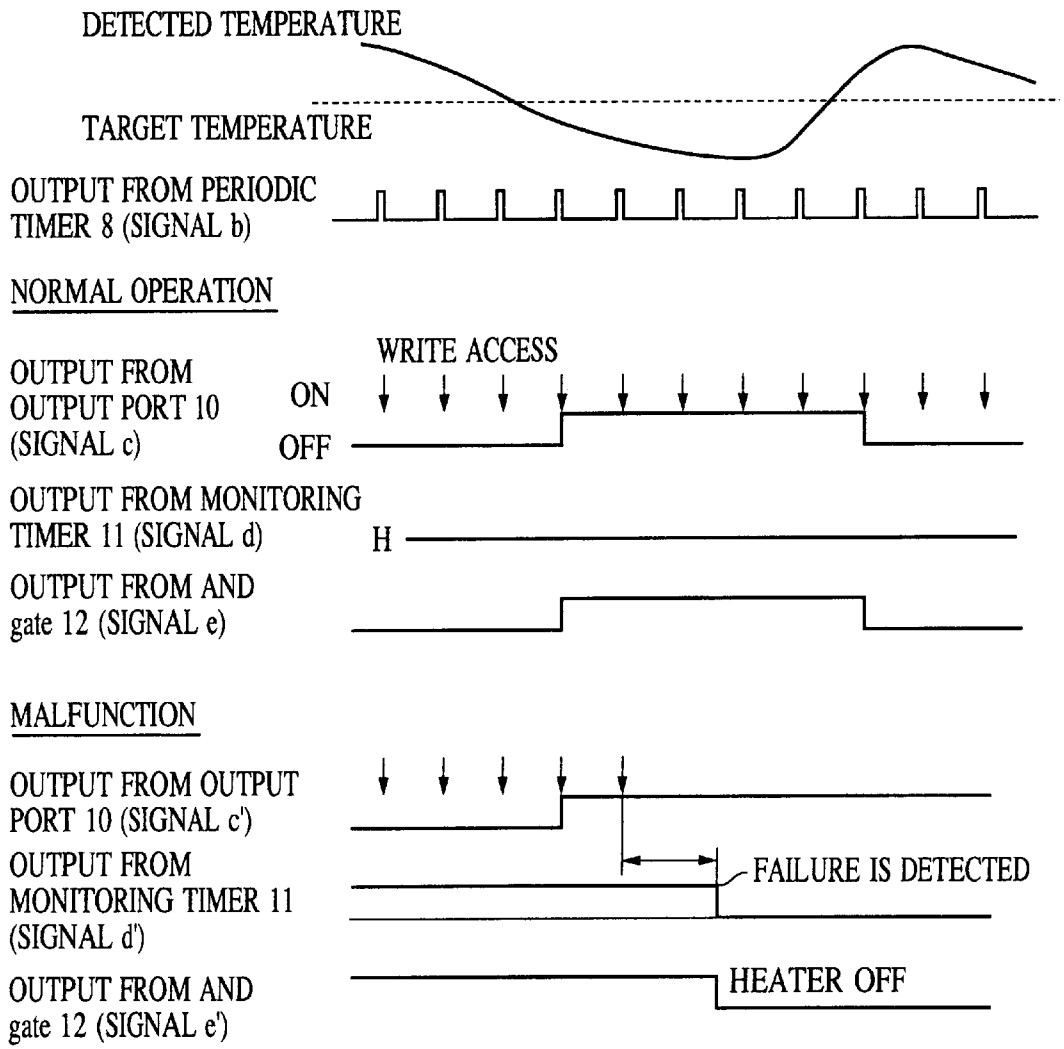
FIGS. 3(*a*) through 3(*h*) are timing charts for illustrating the temperature control operation.

In contrast, when the detected temperature is lower than the target temperature at the time the timer output b of the periodic timer 8 is input, the microcomputer 6 gains write access (signal c) causing the output port P2, relative to the switching circuit 4, to be H (FIG. 3 (*c*)).

When the detected temperature has not reached the target temperature by the time the next timer output b of the periodic timer 8 is input, the microcomputer 6 gains write access again causing the output port P2 to be H even if the control signal c for the switching circuit 4 has already been H.

In contrast, when the microcomputer 6 is malfunctioning or the like, no periodic write access is gained while the output port 10 is outputting H as in a signal c' (FIG. 3 (*f*)). The monitoring timer 11 outputs a failure signal d' (FIG. 3 (*g*)), and it is thus detected that there is a certain failure in the microcomputer 6.

Figure 4:
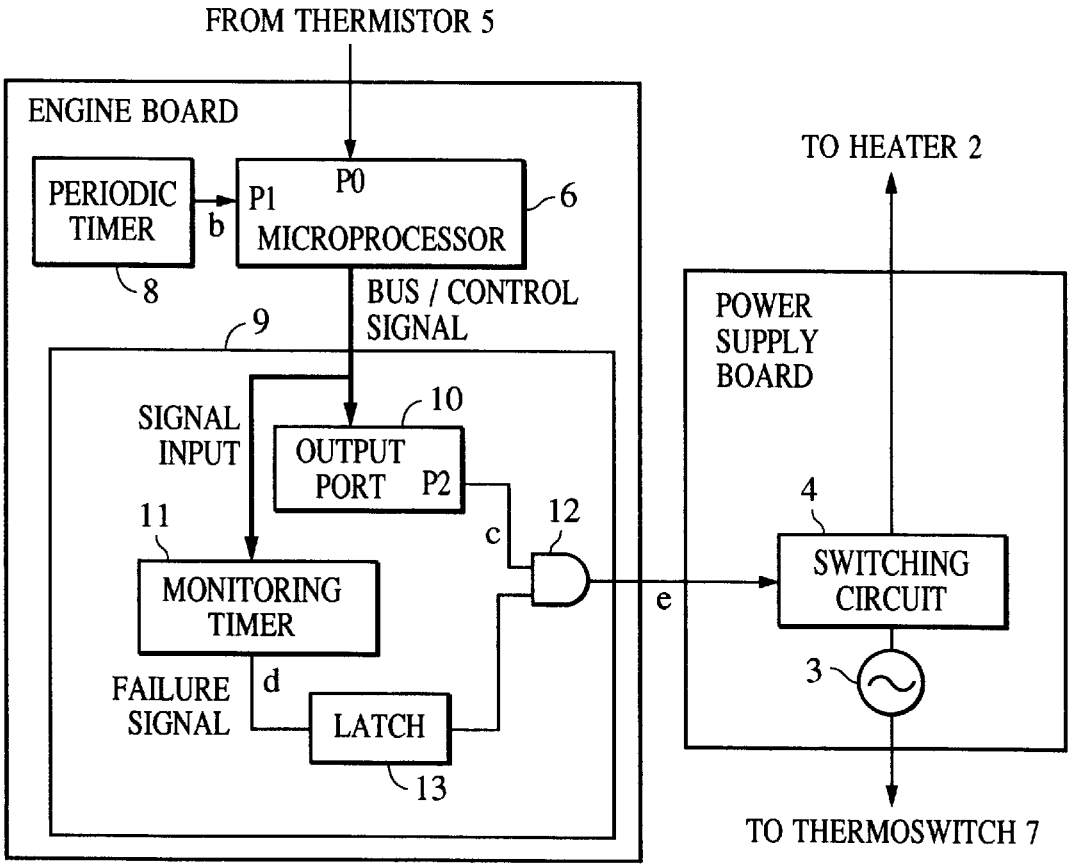
FIG. 4 is a block diagram of an example of a circuit that can latch a failure signal.

When the failure is detected and a failure detection signal d is output, the signal is latched by a latch 13, as shown in FIG. 4. This prevents the heater 2 from again being turned ON.

When the microcomputer 6 of a temperature control system is malfunctioning, all devices under the control of the microcomputer 6 may function abnormally. It is thus undesirable to allow the microcomputer 6 to continuously operate. In the case of detection of a temperature control failure, it is desirable that the microcomputer 6 be reset. In such a case, the microcomputer 6 is reset, and the system is restarted. In order to ensure that the heater 2 is not again turned ON even when the temperature of a temperature-controlled device is high due to a malfunction, the latched failure detection signal is not reset. The latched failure detection signal is maintained whereas the microcomputer 6 is reset. Accordingly, electricity to the heater 2 can be continuously cut off.

Although the method for cutting off electricity to the heater 2 by masking the control signal to the switching circuit 4 has been described in the above description, a cut-out relay can be provided between a power supply and the switching circuit 4, and the power feed to the heater 2 can thereby be cut off by the failure detection signal.

Although an example in which functional blocks are separate has been described in the first embodiment, the periodic timer 8 and/or the monitoring timer 11 can be included in the microcomputer 6.

Optionally, an IC including the periodic timer 8, the monitoring timer 11, the output port P2, and the like can be formed.

The heater 2 may be a heater including a dielectric coil and an electromagnetic-induction heating member. Although an example in which the thermistor 5, which is a contact-type temperature sensor, is used as a temperature detector, instead of using the thermistor 5, a non-contact-type temperature sensor including a built-in thermistor can be used.

Second Embodiment

Figure 5:
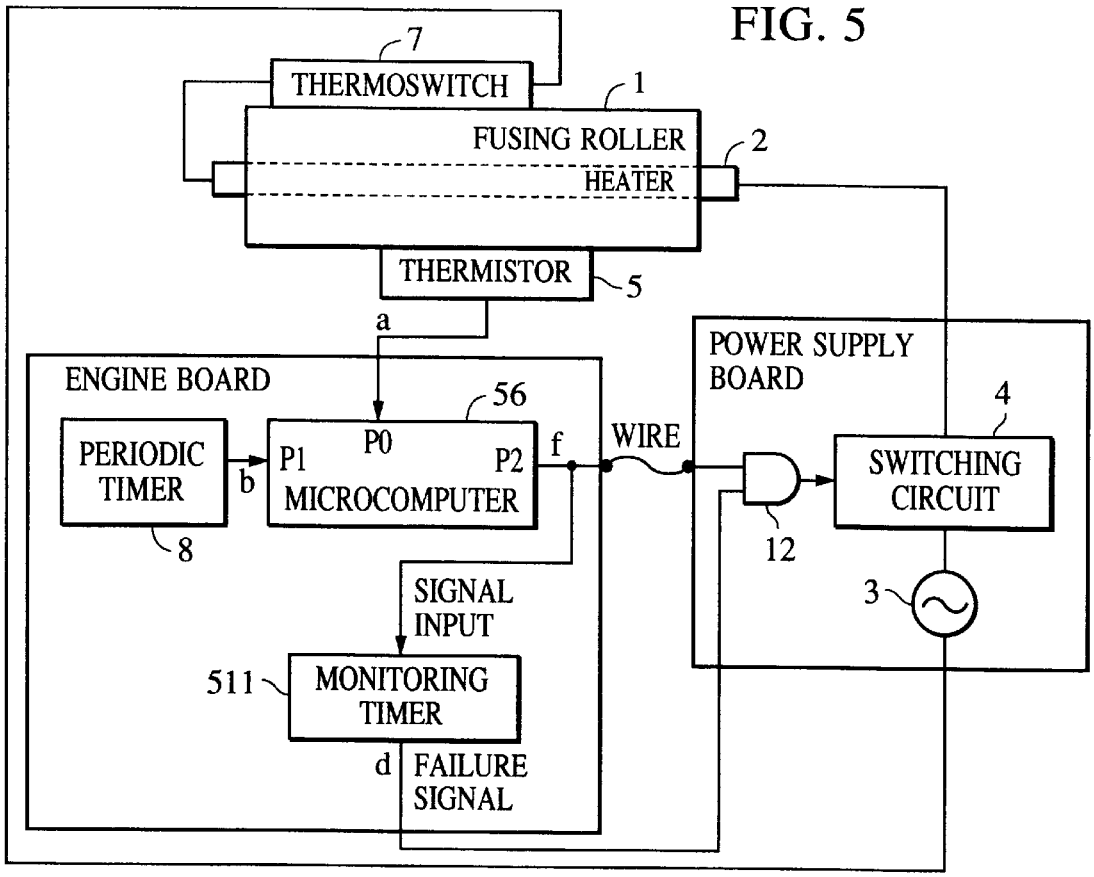
FIG. 5 is a block diagram of a temperature control apparatus according to a second embodiment of the present invention.

FIG. 5 shows a temperature control apparatus according to a second embodiment of the present invention. Compared with the first embodiment, the second embodiment employs a different failure detection method. Specifically, in the first embodiment, the monitoring timer 11 outputs a failure signal when the output port 10 is ON and when there is no write access to again turn ON the port P2 or no write access to turn OFF the port P2 for a preset period of time.

In contrast, in the second embodiment, when the timer output b of the periodic timer 8 is input to an input port P1, a microcomputer 56 performs A/D conversion of the voltage signal a which is output from the thermistor 5, converts the signal into a temperature, and compares the detected temperature with the target temperature. The microcomputer 56 outputs the control signal f from the output port P2 for turning ON/OFF the switching circuit 4. While the control signal f is H indicating that the switching circuit is ON, a monitoring timer 511 measures time. While the control signal f is L indicating that the switching circuit 4 is OFF, the monitoring timer 511 is reset. When the control signal f is continuously H for a preset period of time or longer, the monitoring timer 511 outputs the failure signal d. The preset period of time is longer than the period of the periodic timer 8. The failure signal d output from the monitoring timer 511 becomes L when a failure is detected, and the failure signal d is input to the AND gate 12. Since a heater-ON signal is masked when a failure is detected, the heater 2 is turned OFF.

In the second embodiment, the microcomputer 56, the periodic timer 8, and the monitoring timer 511 are disposed on the engine board. The AC power supply 3, the switching circuit 4, and the AND gate 12 are disposed on the power supply board.

Figure 6:
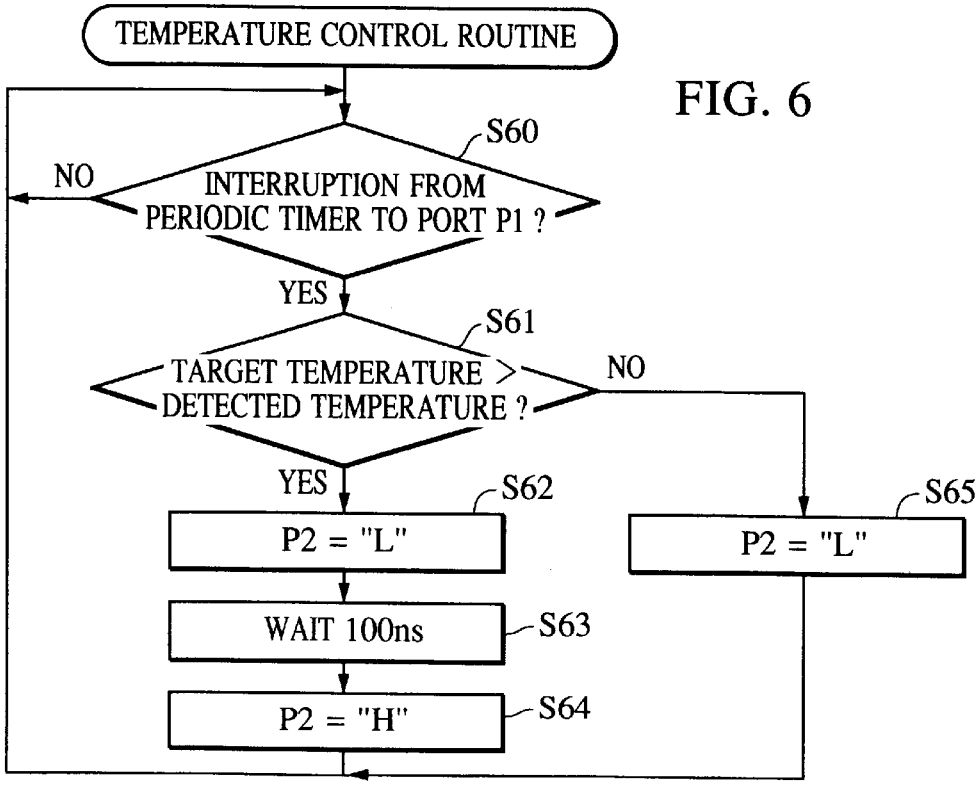
FIG. 6 is a flowchart showing an example of a program stored in a microcomputer.

FIG. 6 is a flowchart showing an example of a program stored in the microcomputer 56. When it becomes necessary to perform temperature control, in step S60, a temperature control routine waits for the timer output b of the periodic timer 8 to be output to the port P1. In response to the timer output b, in step S61, the routine compares a detected temperature, which is obtained by converting the voltage signal a from the thermistor 5 into a temperature, with the target temperature. When the detected temperature is higher than the target temperature, the routine outputs signal L (control signal f) in step S65, instructing heater-OFF, to the output port P2. The routine returns to step S60 and waits for a next timer input. In contrast, if the detected temperature is lower than the target temperature in step S61, the routine transmits signal L (control signal f) in step S62, instructing heater-OFF, to the output port P2. In step S63, the routine waits a predetermined very short period of time (for example, 100 ns). Subsequently, in step S64, the routine transmits signal H instructing heater-ON to the output port P2 and returns to step S60.

When the output port P2 has already been H, and when the detected temperature is lower than the target temperature, the processing in steps S62 to S64 causes the output port P2 to be L and then to be H. As long as there is no failure in the microcomputer 56 or in the output port P2, the control signal f periodically becomes L and that the monitoring timer 511 detects no failure.

When the monitoring timer 511 detects a failure, it detects that there is a failure in the microcomputer 56, the output port P2, or the control signal f driven by the output port P2.

Although an example in which the monitoring timer 511 is disposed on the engine board has been described in the second embodiment, alternatively, the monitoring timer 511 can be disposed on the power supply board instead of the engine board.

Referring to FIG. 7, the operation will now be described. The periodic timer 8 outputs the timer output b with a predetermined period (for example, 200 ms) (FIG. 7 (*b*)). When the timer output b of the periodic timer 8 is input, the microcomputer 56 compares the temperature detected by the thermistor 5 with the target temperature (FIG. 7 (*a*)). When the detected temperature is higher than the target temperature, the control signal f for the switching circuit 4 becomes L, and no electricity is supplied to the heater 2.

When the detected temperature is lower than the target temperature at the time the timer output b of the periodic timer 8 is input, the microcomputer 56 causes the control signal f for the switching circuit 4 to be L and then to H (FIG. 7 (*c*)). When the detected temperature has not reached the target temperature by the time the next timer output b of the periodic timer 8 is input, the microcomputer 56 again causes the control signal f for the switching circuit 4 to be L and then to be H (FIG. 7 (*c*)).

When the microcomputer 56, the output port P2, and the timer are functioning properly and the control signal is normal, the control signal f has an L pulse with a very-short pulse width for each control period, as shown in FIG. 7(*c*), even if it is necessary to have the heater 2 continuously turned ON. In other words, the presence of the L pulse indicates that the periodic temperature control is properly performed.

In contrast, in case of a failure, as in the control signal f, H is maintained for at least a predetermined period (FIG. 7 (*e*)). The monitoring timer 511 outputs a failure signal (FIG. 7 (*f*)), thereby detecting that a certain failure has occurred.

In the second embodiment, even when it is necessary to continuously cause the control signal f for the switching circuit 4 to become H, the control signal f periodically becomes L. As a result, a failure in the microcomputer 56 can be detected. However, when the switching circuit 4 is periodically turned ON/OFF by periodically causing the control signal f to become L, an adverse effect such as flickering may be caused.

Referring to FIG. 8, when a failure is detected, a failure detection signal output from the monitoring timer 511 is latched by a latch 813. The signal latched by the latch 813 and the control signal f from the microcomputer 56 are ANDed with each other by an AND gate 812. The output of the AND gate 812 is output through a filter 814 to the switching circuit 4.

By latching the failure signal d, the heater 2 is prevented from again being turned ON. Since the output of the AND gate 812 is output through the filter 814 to the switching circuit 4, the switching circuit 4 does not respond to an L pulse with very short duration.

When a failure occurs in the temperature control system, the microcomputer 56 controlling the temperature control system may be malfunctioning and it is undesirable to allow the microcomputer 56 to continue to operate.

In such a case, it is desirable that the microcomputer 56 be reset. The microcomputer 56 is reset, and the system is restarted. In order to ensure that the heater 2 is not again turned ON even when the temperature of a temperature-controlled device is high due to a malfunction, the latched failure detection signal is not reset. The latched failure detection signal is maintained whereas the microcomputer 56 is reset. Accordingly, electricity to the heater 2 can be continuously cut off.

Although the method for cutting off electricity to the heater 2 by masking the control signal to the switching circuit 4 has been described in the above description, a cut-out relay can be provided between a power supply and the switching circuit 4, and the power feed to the heater 2 can thereby be cut off by the failure detection signal.

Although an example in which functional blocks are separate has been described in the second embodiment, for example, the periodic timer 8 and/or the monitoring timer 511 can be included in the microcomputer 56. Also, an IC including the periodic timer 8, the monitoring timer 511, the output port P2, and the like can be formed.

Third Embodiment

Figure 9:
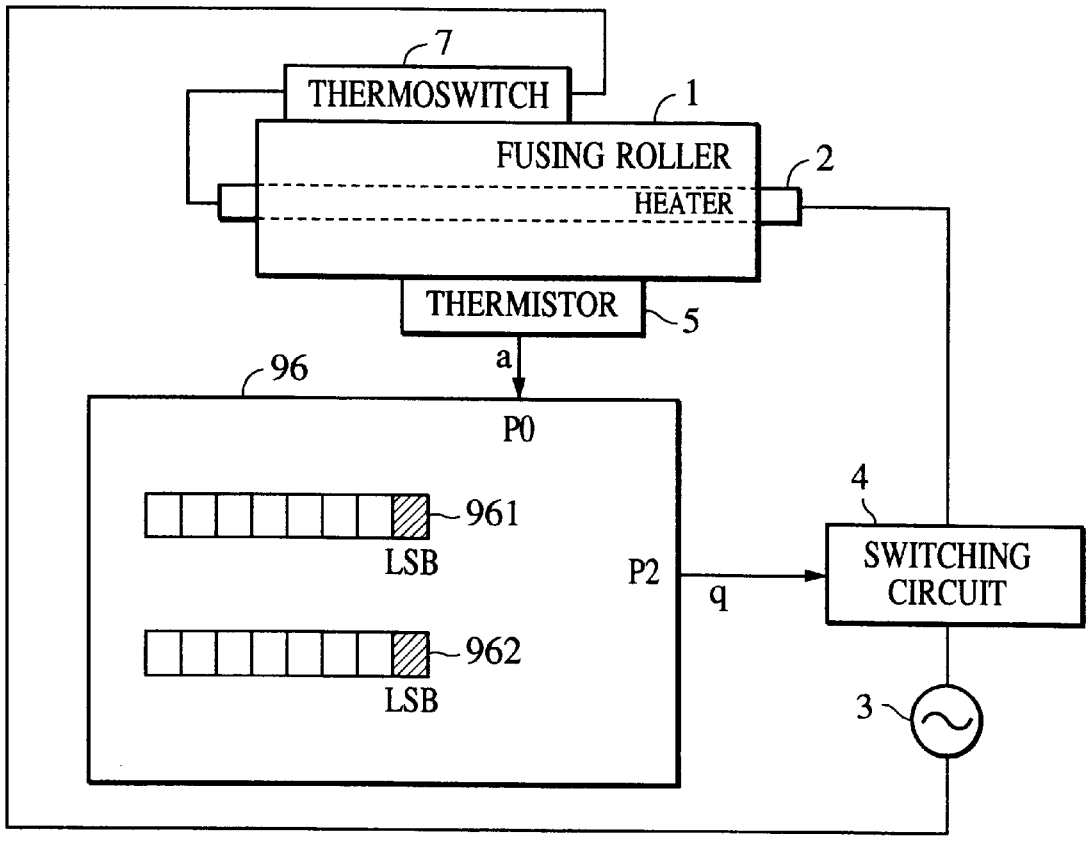
FIG. 9 is a block diagram of a temperature control apparatus according to a third embodiment of the present invention.

FIG. 9 shows a temperature control apparatus according to a third embodiment of the present invention. The third embodiment differs from the first embodiment in that a different temperature control method is employed in the third embodiment. Specifically, in the first embodiment, when the output port 10 is ON, and when there is no write access to again turn ON the port P2 nor write access to turn OFF the port P2 for a preset period of time or longer, the monitoring timer 11 outputs a failure signal.

In contrast, in the third embodiment, a microcomputer 96 includes a heater-protection register 961 and a heater ON/OFF register 962. When the microcomputer 96 writes 1 to the least significant bit (LSB) of the heater-protection register 961, it enters a heater-ON permitted state. When, in the heater-ON permitted state, the microcomputer 96 writes 1 to the LSB of the heater ON/OFF register 962, the output port P2 (signal g) of the microcomputer 96 becomes H indicating the heater-ON state. As a result, the switching circuit 4 is turned ON, and power is supplied to the heater 2.

When it becomes necessary to control the temperature of the heater 2, the microcomputer 96 converts the voltage signal a which is periodically input to the input port P0 into a temperature. When the detected temperature is lower than the target temperature, the heater 2 is turned ON. When the detected temperature is higher than the target temperature, the heater 2 is turned OFF.

In the third embodiment, when turning ON the heater 2, a predetermined value is written to the heater-protection register 961, and it enters the heater-ON permitted state. Subsequently, a predetermined value is written to the heater ON/OFF register 962. Compared with a known example in which heater ON/OFF is controlled using a single register, the possibility of turning ON the heater 2 in response to a malfunction in the microcomputer 96 is reduced. As a result, malfunctions can be reduced.

When turning OFF the heater 2, instead of writing predetermined values to the LSBs of the heater-protection register 961 and the heater ON/OFF register 962, 0 can be written to the LSB of the heater ON/OFF register 962, which results in turning OFF the heater 2. At the same time, heater-protection register 961 can be cleared so that the heater-protection register 961 will enter the heater-ON denied state.

Alternatively, when turning ON the heater 2, the heater 2 is turned ON when a predetermined value is written to the LSB of the heater ON/OFF register 962 in the heater-ON permitted state. At the same time, the entire heater-protection register 961 is cleared.

In order to ensure safety in case of a malfunction in the microcomputer 96, it is preferable that registers related to the heater-ON operation be separate from registers with other functions including a motor ON/OFF function and a solenoid ON/OFF function.

When turning on the heater 2, instead of simply writing specific values to specific bits of the heater-protection register 961 and the heater ON/OFF register 962, a keyword consisting of a plurality of bits can be written to each register. Accordingly, it is possible to lower the risk of incorrect writing caused by missing bits due to noise.

As described above, with the registers, it is possible to determine whether or not the microcomputer 96 is functioning properly. Specifically, when the heater/protection register 961 is in the heater-ON denied state since no predetermined value is written thereto, and when 1 (heater-ON) is written to the LSB of the heater ON/OFF register 962, the operation of the microcomputer 96 is abnormal. It is thus detected that the microcomputer 96 is malfunctioning.

With regard to temperature control, when the microcomputer 96 is malfunctioning, there is a possibility that the microcomputer 96 that performs temperature control may have become broken, and it is undesirable that the broken microcomputer 96 continue operating. When a malfunction is detected, it is desirable to reset the microcomputer 96.

In such a case, the microcomputer 96 is reset, and the system is restarted. In order to ensure that the heater 2 is not again turned ON even when the temperature of a temperature-controlled device is high due to a malfunction, a failure signal is latched whereas the microcomputer 96 is reset. A heater-ON signal is masked by the failure signal, so that the heater-ON signal is prevented from being output.

Although an example in which the registers are included in the microcomputer 96 has been described, an IC including the registers can be formed instead.

Fourth Embodiment

Figure 10:
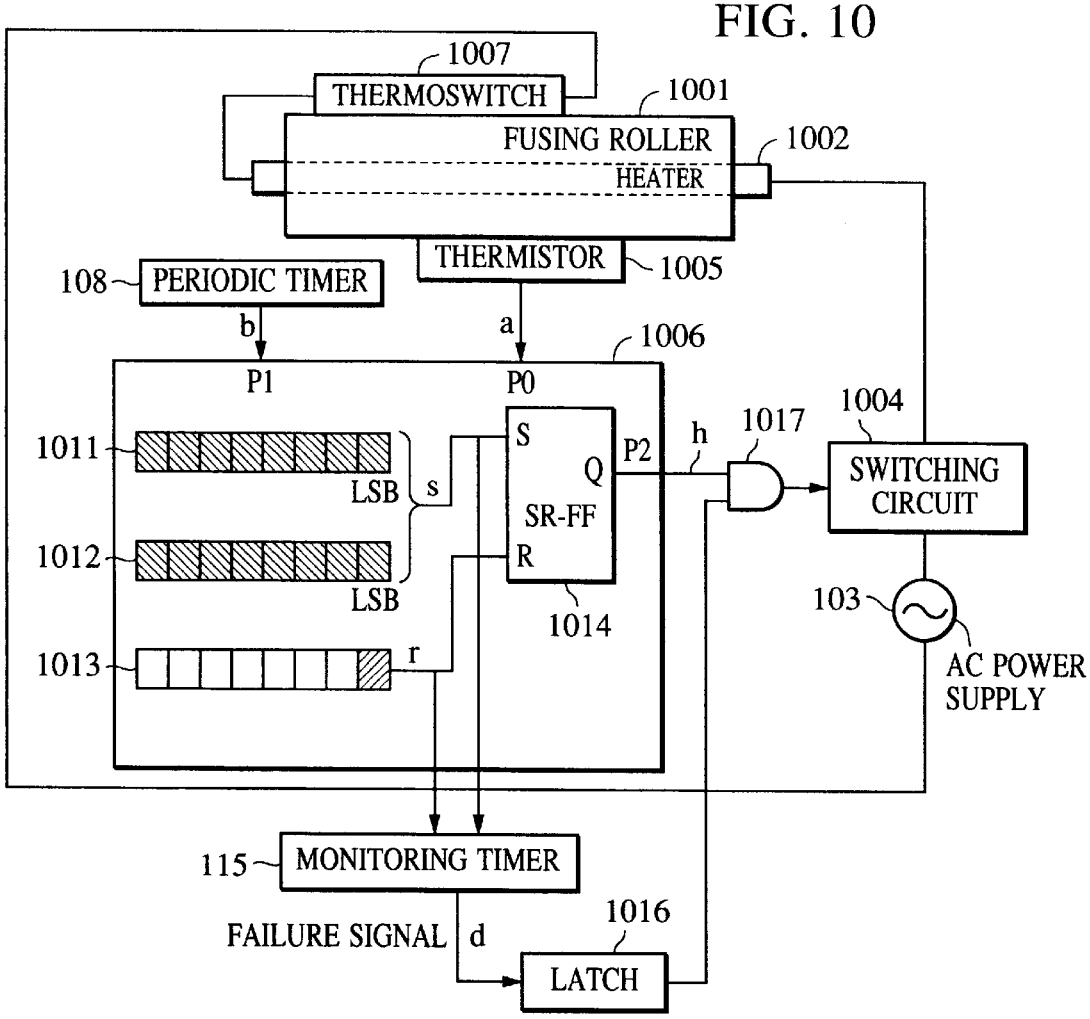
FIG. 10 is a block diagram of a temperature control apparatus according to a fourth embodiment of the present invention.
Figure 11:
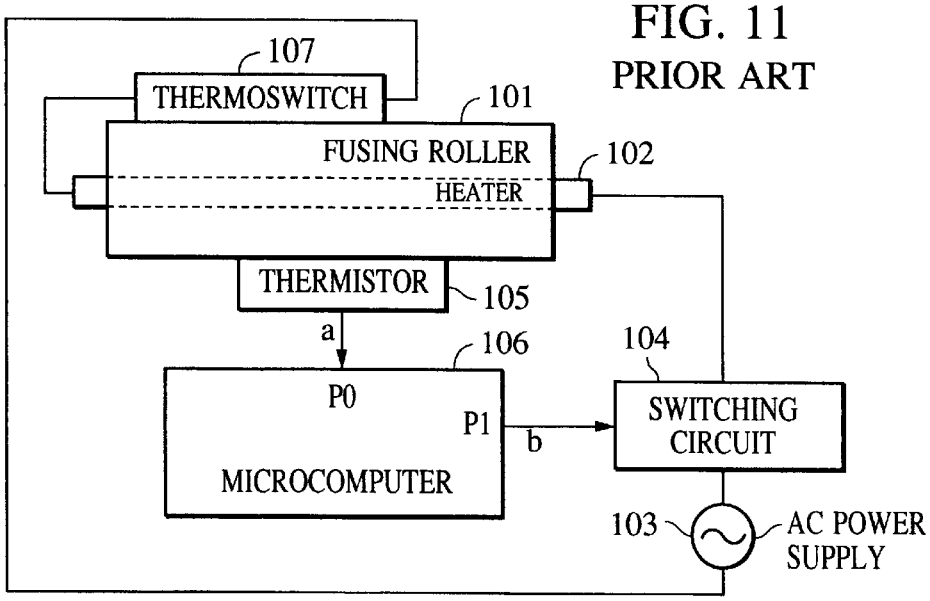
FIG. 11 PRIOR ART
FIG. 11 is a block diagram of an example of a known temperature control apparatus.
Figure 12:
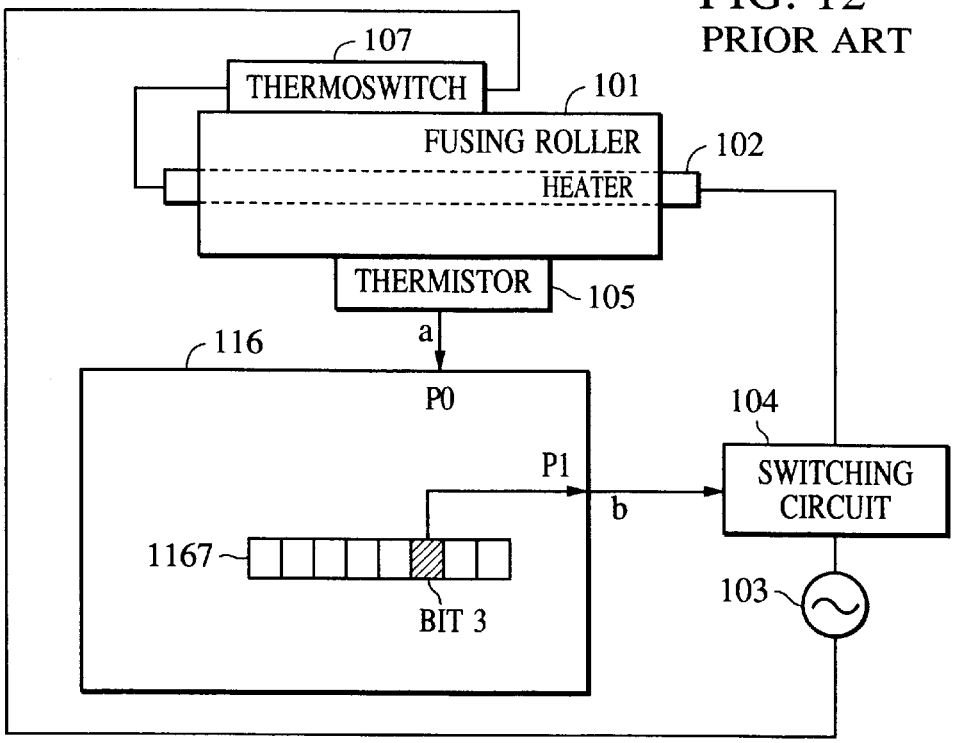
FIG. 12 PRIOR ART
FIG. 12 is a block diagram of another example of a known temperature control apparatus.
Figure 13:
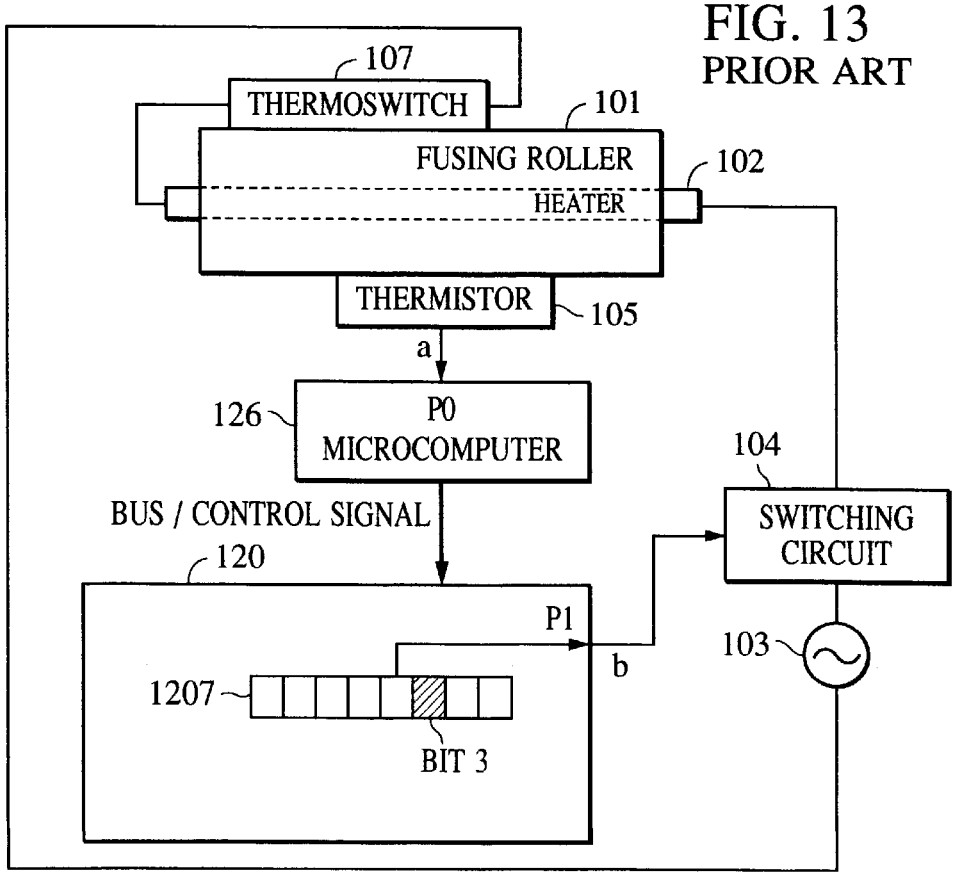
FIG. 13 PRIOR ART
FIG. 13 is a block diagram of another example of a known temperature control apparatus.

FIG. 10 shows a temperature control apparatus according to a fourth embodiment of the present invention. The fourth embodiment differs from the third embodiment in the register configuration. Specifically, in the third embodiment, the configuration includes the heater-protection register 961 and the heater ON/OFF register 962.

In contrast, in the fourth embodiment, a microcomputer 1006 includes a heater-protection register 1011, a heater-ON register 1012, and a heater-OFF register 1013.

When the microcomputer 1006 writes the keyword "19" to the heater-protection register 1011, the heater-protection register 1011 enters the heater-ON permitted state. When the microcomputer 1006 writes "C8" to the heater-ON register 1012, H pulse is output to a signal s. In response to this, an SR-FF (set-reset flip flop) 1014 is set. The output port h of the microcomputer 1006 becomes H indicating the heater-ON state. As a result, a switching circuit 1004 is turned ON, and power is supplied to a heater 1002. The heater-protection register 1011 and the heater-ON register 1012 are cleared (00) by the H pulse of the signal S.

In contrast, when turning OFF the heater 1002, the microcomputer 1006 sets "1" to the LSB of the heater-OFF register 1013, thus outputting an H pulse to a signal r. In response to this, the SR-FF 1014 is reset. The output port h of the microcomputer 1006 becomes L indicating the heater-OFF state. As a result, the switching circuit 1004 is turned OFF, and power to the heater 1002 is cut off. The heater-OFF register 1013 is cleared (0) by the H pulse of the signal r.

When it becomes necessary to control the temperature of the heater 1002, the microcomputer 1006 waits for the timer output of a periodic timer 108 to be input to an input port P1. When the timer output is input, the microcomputer 1006 converts voltage signal a which is input to input port P0 into a temperature. When the detected temperature is lower than the target temperature, the heater 1002 is turned ON by the above-described procedures. When the detected temperature is higher than the target temperature, the heater 1002 is turned OFF.

Even if it is necessary to have the heater 1002 continuously turned ON, the microcomputer 1006 is programmed to turn ON the heater 1002 by the foregoing procedures every time the timer output of the periodic timer 108 is output.

A monitoring timer 115 clocks the ON-period of an output port P2. When H pulse is generated in the signal s or the signal r, the monitoring timer 115 resets the clocking. When the output port P2 is turned ON, and when no H pulse is generated in the signal s or the signal r for a preset period of time or longer, the monitoring timer 115 outputs a failure signal. The preset period of time is longer than the period of the periodic timer 108.

A failure signal d output from the monitoring timer 115 becomes L when a failure is detected. The failure signal d is latched by a latch 116, and the latched signal is input to an AND gate 1017. When a failure is detected, the output e of the AND gate 1017 becomes L. Accordingly, the switching circuit 104 is turned OFF.

In the fourth embodiment, when turning ON the heater 1002, a predetermined value is written to the heater-protection register 1011, and hence the heater-protection register 1011 enters the heater-ON permitted state. Subsequently, a predetermined value is written to the heater-ON register 1012. Compared with a known example in which heater ON/OF control is performed using a single register, the possibility of the heater 1002 being turned ON incorrectly as a result of a malfunction in the microcomputer 1006 is reduced. Therefore, malfunctions can be reduced.

Similar to the first embodiment, when it is necessary to have the heater 1002 continuously turned ON, "19" is periodically written to the heater-protection register 1011, and "C8" is written to the heater-ON register 1012. If not, it can be determined that there is a malfunction in the microcomputer 1006.

With regard to the heater-protection register 1011 and the heater-ON register 1012, it can be detected that the microcomputer 1006 is malfunctioning when at least one of the following three types of accesses is gained:

the contents of the heater-protection register 1011 become bits other than "19" and "00";

the contents of the heater-ON register 1012 become bits other than "C8" and "00"; and the heater-ON register 1012 becomes "C8" although the heater-protection register 1011 is "00". In these cases, the heater 1002 is turned OFF.

In order to ensure safety in case of a malfunction in the microcomputer 1006, it is preferable that registers related to the heater-ON operation be separate from registers with other functions including a motor ON/OFF function and a solenoid ON/OFF function.

With regard to temperature control, when the microcomputer 1006 is malfunctioning, there is a possibility that the microcomputer 1006 that performs temperature control may have become broken. It is undesirable that the microcomputer 1006 continue operating. When a malfunction is detected, it is desirable to reset the microcomputer 1006.

In such a case, the microcomputer 1006 is reset, and the system is restarted. In order to ensure that the heater 1002 is not again turned ON, even when the temperature of a temperature-controlled device is high due to a malfunction, a failure signal is latched whereas the microcomputer 1006 is reset. A heater-ON signal is masked by the failure signal, so that the heater-ON signal is prevented from being output.

Although an example in which the registers are included in the microcomputer 1006 has been described, an IC including the registers can be formed instead.

When a failure is detected in the foregoing embodiments, it is preferable that the failure be reported by displaying the failure on a display panel or sounding a buzzer.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A temperature control apparatus comprising:

a temperature detector for detecting a temperature of a heating unit;

a switching circuit for turning ON/OFF a power supply to the heating unit;

an instruction unit for outputting, when controlling the temperature, an instruction signal instructing said switching circuit to at least one of turning ON and OFF of the power supply to the heating unit on the basis of the detected temperature; and a switching controller for controlling ON/OFF of said switching circuit in accordance with the instruction signal when the instruction signal which is to be periodically output by said instruction unit is output within a predetermined period of time that is longer than the instruction-signal output period, and, when no instruction signal is output, for turning OFF said switching circuit.

2. A temperature control apparatus according to claim 1, wherein said instruction unit outputs the instruction signal instructing one of turning ON and OFF in each output period; and said switching controller turns OFF said switching circuit when neither the instruction signal instructing turning ON nor the instruction signal instructing turning OFF is output within the predetermined period of time.

3. A temperature control apparatus according to claim 1, wherein said instruction unit outputs the instruction signal instructing turning OFF at least once in each output period; and said switching controller turns OFF said switching circuit when the instruction signal instructing turning OFF is not output from said instruction unit within the predetermined period of time.

4. A temperature control apparatus according to claim 1, wherein said switching controller comprises:

a generation unit for generating a failure detection signal when the instruction signal which is to be periodically output from said instruction unit is not output within the predetermined period of time; and a latch unit for latching the failure detection signal generated by said generation unit, wherein said switching circuit is turned OFF by the failure detection signal latched by said latch unit.

5. A temperature control apparatus according to claim 4, further comprising an initialization unit for initializing said temperature control apparatus when the instruction signal which is to be periodically output from said instruction unit is not output within the predetermined period of time, wherein said latch unit is not initialized by said initialization unit and maintains the failure detection signal after the initialization, the failure detection signal having been maintained prior to the initialization.

6. A temperature control apparatus according to claim 1, further comprising an informing unit for reporting a failure when the instruction signal to be output from said instruction unit is not output within the predetermined period of time.

7. A temperature control apparatus according to claim 1, wherein said heating unit comprises a fusing roller with a heater.

8. A temperature control apparatus according to claim 1, wherein said heating unit comprises an induction coil and an electromagnetic-induction heating member.

9. A temperature control apparatus according to claim 1, wherein said temperature detector comprises a contact-type temperature sensor for making contact with an object and detecting the temperature of the object.

10. A temperature control apparatus according to claim 1, wherein the temperature detector comprises a non-contact-type temperature sensor for detecting the temperature of an object without making contact with the object.

11. A temperature control apparatus comprising:

a temperature detector for detecting a temperature of a heating unit;

a switching circuit for turning ON/OFF a power supply to said heating unit;

a decision unit for deciding whether to turn ON or OFF the power supply to said heating unit on the basis of the temperature detected by said temperature detector;

a first register and a second register;

a first setting unit for setting a first predetermined value to said first register when it is decided on the basis of the temperature detected by said temperature detector that the power should be supplied to said heating unit;

a second setting unit for setting a second predetermined value to said second register before said first setting unit sets the first predetermined value to said first register; and a determination unit for determining whether or not the contents of said second register match the second predetermined value, wherein turning ON of the power supply by said switching circuit takes place when the first predetermined value is set to said first register on condition that said determination unit determines that the contents of said second register match the second predetermined value.

12. A temperature control apparatus according to claim 11, wherein, when it is decided to turn OFF the power supply to said heating unit on the basis of the temperature detected by said temperature detector, said first setting unit sets a third predetermined value differing from the first predetermined value to said first register.

13. A temperature control apparatus according to claim 11, further comprising a clearing unit for clearing at least one of said first register and said second register when said determination unit determines that the contents of said second register match the second predetermined value and that the first predetermined value is set to said first register.

14. A temperature control apparatus according to claim 11, wherein, when the first predetermined value is written to said first register and the contents of said second register do not match the second predetermined value, said switching circuit is turned OFF.

15. A temperature control apparatus according to claim 14, further comprising an informing unit for reporting the occurrence of a failure when the first predetermined value is written to said first register and the contents of said second register do not match the second predetermined value.

16. A temperature control apparatus according to claim 14, further comprising an initialization unit for initializing said temperature control apparatus when the first predetermined value is written to said first register and the contents of said second register do not match the second predetermined value.

17. A temperature control apparatus according to claim 16, further comprising a maintaining unit for maintaining the failure state when the first predetermined value is written to said first register and the contents of said second register do not match the second predetermined value, wherein, when the failure state is maintained by said maintaining unit, it continuously inhibits turning ON the power supply by said switching circuit after the initialization by said initialization unit.

18. A temperature control apparatus according to claim 11, further comprising:

a third register; and a third setting unit for setting a third predetermined value to said third register when said decision unit decides that the power supply to said heating unit should be turned OFF, wherein, when the third predetermined value is written to said third register, said switching circuit is turned OFF.

19. A temperature control apparatus according to claim 18, further comprising a maintaining unit for maintaining a control signal for controlling ON/OFF of the power supply by said switching circuit, wherein, when controlling the temperature, said first setting unit and said second setting unit are caused to write to said first register and said second register, respectively, within a predetermined period, or said third setting unit is caused to write to said third register within the predetermined period;

when the first predetermined value and the second predetermined value are set to said first register and said second register, respectively, said maintaining unit is caused to maintain the control signal indicating ON; and when the third predetermined value is set to said third register, said maintaining unit is caused to maintain the control signal indicating OFF.

20. A temperature control apparatus according to claim 19, wherein, when the third predetermined value is set to said third register, said third register is cleared.

21. A temperature control apparatus according to claim 19, further comprising a clearing unit for clearing said first register and said second register when said determination unit determines that the contents of said second register match the second predetermined value and the first predetermined value is set to said first register.

22. A temperature control apparatus according to claim 21, further comprising a turning-OFF for turning OFF power supply by said switching circuit when at least one of the contents of said first register is not a cleared value or the first predetermined value, or the content of said second register is not a cleared value or the second predetermined value.

23. A temperature control apparatus according to claim 19, wherein said switching circuit turns off the power supply when neither the writing by said first setting unit and said second setting unit to said first register and said second register, respectively, nor the writing by said third setting unit to said third register is performed within a predetermined time.

24. A temperature control apparatus according to claim 23, further comprising an inhibiting unit for inhibiting turning ON of said switching circuit in accordance with the control signal maintained by said maintaining unit when said determination unit determines that a failure has occurred.

25. A temperature control apparatus according to claim 19, further comprising a latch unit for latching a failure detection signal when neither the writing by said first setting unit and said second setting unit to said first register and said second register, respectively, nor the writing by said third setting unit to said third register is performed within a predetermined time; and an initialization unit for initializing said temperature control apparatus, where in said latch unit is not initialized by said initialization unit and maintains the failure detection signal after the initialization, the failure detection signal having been maintained prior to the initialization.

26. A temperature control apparatus according to claim 11, wherein said heating unit comprises a fusing roller with a heater.

27. A temperature control apparatus according to claim 11, wherein said heating unit comprises an induction coil and an electromagnetic-induction heating member.

28. A temperature control apparatus according to claim 11, wherein said temperature detector comprises a contact-type temperature sensor for making contact with an object and detecting the temperature of the object.

29. A temperature control apparatus according to claim 11, wherein said temperature detector comprises a non-contact-type temperature sensor for detecting the temperature of an object without making contact with the object.

30. A temperature control apparatus according to claim 11, wherein said temperature detector comprises a thermistor.

* * * * *

UNITED STATES PATENT AND TRADEMARK OFFICE

CERTIFICATE OF CORRECTION

PATENT NO. : 6,608,977 B2
DATED : August 19, 2003
INVENTOR(S) : Tomohiro Tamaoki It is certified that error appears in the above-identified patent and that said Letters Patent is hereby corrected as shown below:

Column 3,
Line 17, “third of” should read -- third --.

Column 13,
Line 35, “signal S.” should read -- signal s. --.

Column 18,
Line 20, “where in” should read -- wherein --.

Signed and Sealed this

Thirteenth Day of January, 2004

JON W. DUDAS
*Acting Director of the United States Patent and Trademark Office*